United States Patent [19]

Pippes

[11] Patent Number: 4,934,913

[45] Date of Patent: Jun. 19, 1990

[54] INTERNAL-GEAR MACHINE WITH FLUID OPENING IN NON-BEARING TOOTH FLANK

[75] Inventor: Reinhard Pippes, Bretten-Spranntal, Fed. Rep. of Germany

[73] Assignee: Otto Eckerle GmbH & Co. KG, Malsch, Fed. Rep. of Germany

[21] Appl. No.: 272,487

[22] Filed: Nov. 16, 1988

[30] Foreign Application Priority Data

Feb. 19, 1988 [DE] Fed. Rep. of Germany ..... 3805186

[51] Int. Cl.[5] ..... F01C 1/10; F04C 2/10

[52] U.S. Cl. ..... 418/169; 418/190

[58] Field of Search ..... 418/168, 169, 190

[56] References Cited

U.S. PATENT DOCUMENTS

| | | | |
|---|---|---|---|
| 751,196 | 2/1904 | Nielsen | 418/169 |
| 1,496,737 | 6/1924 | Petersen | 418/169 |
| 3,448,615 | 6/1969 | Schneider, Jr. | 418/169 |
| 3,545,898 | 12/1970 | Bobst | 418/190 |
| 3,981,646 | 9/1976 | Bottoms | 418/190 |
| 4,233,005 | 11/1980 | Bottoms et al. | 418/190 |

FOREIGN PATENT DOCUMENTS

| | | | |
|---|---|---|---|
| 1802984 | 6/1969 | Fed. Rep. of Germany . | |
| 2933493 | 3/1981 | Fed. Rep. of Germany | 418/169 |

*Primary Examiner*—John J. Vrablik

*Attorney, Agent, or Firm*—Hoffmann & Baron

[57] ABSTRACT

An internal-gear machine such as a pump comprises an internally toothed annular gear and an externally toothed pinion which meshes with the internal teeth of the annular gear over a portion of the periphery thereof, an arcuate filling member being disposed between the annular gear and the pinion. The annular gear has openings which connect the outside periphery of the annular gear with the inward side thereof in the region of the gaps between the teeth. Each opening is set into the non-bearing flank of the respective tooth which delimits on one side the gap between a pair of teeth, to such an extent that at the same time each opening forms a communication between the root of the respective tooth and the tip of the tooth.

12 Claims, 4 Drawing Sheets

INTERNAL-GEAR MACHINE WITH FLUID OPENING IN NON-BEARING TOOTH FLANK

BACKGROUND OF THE INVENTION

The invention relates generally to an internal-gear machine such as an internal-gear pump.

In internal-gear machines such as a pump, an externally toothed pinion or pump impeller is mounted eccentrically with respect to the body of the pump, for actuating an internally toothed annular gear which is disposed rotatably in the casing of the pump. In pumping operation of such a pump, the fluid which is in the pressure chamber of the pump is displaced out of the gaps between the teeth of the meshing externally toothed pinion and the internally toothed annular gear, by virtue of the increasing engagement or meshing between the teeth of the pinion and the annular gear so that the fluid is conveyed to the outlet of the pump. By virtue of that displacement effect, the fluid is obliged to flow away axially and radially past the teeth of the pinion and the annular gear, which pass into the gaps between the teeth of the annular gear and the pinion respectively. The gap which is available for that flow of fluid between the meshing teeth is however already comparatively small at the beginning of meshing engagement between the teeth so that there is already a comparatively high level of flow resistance to that flow of fluid long before the meshing teeth come into face contact with each other. That flow resistance rises further when the gap available for the flow of fluid between the meshing teeth further decreases in size with further increasing meshing engagement of the teeth and finally falls to zero. That high level of flow resistance manifests itself as a loss of output from the pump. In an endeavour to reduce that power loss, one design of internal-gear pump provides that the annular gear thereof has radial openings which communicate the external periphery of the annular gear with the inward side thereof in the region of the gaps between the teeth, so that the fluid being delivered by the pump is passed to the pump outlet through the opening through the annular gear. The presence of the openings through the annular gear means that, when the gaps between the meshing teeth of the annular gear and the pinion decrease, the fluid can also leave the gaps between the teeth of the meshing components in the direction of the openings through the annular gear so that the phenomenon of fluid being squeezed between the meshing teeth of the gears does not occur, in particular just prior to the condition of full meshing engagement between the teeth. A further improvement along those lines is to be found in another design of internal-gear machine, as disclosed in U.S. Pat. No. 1,739,139, in which, in addition to the openings which communicate the external periphery of the annular gear with the gaps between the teeth thereof, there are further openings which go from the external periphery of the annular gear through the teeth thereof to the tips of the respective teeth and open precisely at the tips of the teeth. By virtue of that arrangement, any fluid which is present and squeezed between the tips of the teeth of the annular gear and the gaps between the teeth of the externally toothed pinion is also conveyed away to the pressure chamber of the pump in the same manner as described above. However the openings in that internal-gear pump can only be comparatively small by virtue of their positioning in the teeth of the annular gear because, if the openings were not small, the strength of the annular gear would be excessively impaired by the openings being of large size and necessarily adjoining each other in close succession. The small size of the openings means that they are therefore of a narrow flow cross-section and therefore in particular the openings which open at the tips of the teeth of the annular gear still afford very narrow flow passages which present a not inconsiderable degree of flow resistance to the fluid to be displaced therethrough. Therefore in that machine the reduction in the loss of power due to the high resistance to flow of the fluid displaced by operation of the machine is only within narrow limits.

In connection with an external-gear pump, in order to remove fluid which is present and squeezed between meshing teeth, radial openings are provided in one of the two intermeshing externally toothed gears, the openings being displaced into the flanks of the respective teeth so that they intersect both the addendum circle and the dedendum circle of the teeth and thus communicate the region of the tips of the teeth and the region of the roots of the teeth with the shaft mounting bore of the gear, as can be seen from German laid-open application (DE-OS) No. 18 02 984. Although that arrangement avoids fluid being trapped between the teeth of the meshing gears, and the resulting loss-generating increase in pressure at the end of the phenomenon of meshing engagement between the co-operating teeth, the part of the fluid being conveyed by the pump, which is carried away to the mounting bore of the gear, represents a not inconsiderable loss of delivery volume from the pump.

SUMMARY OF THE INVENTION

An object of the present invention is to provide an internal-gear machine which presents higher levels of operating efficiency.

Another object of the present invention is to provide an internal-gear pump which provides for an enhanced and more rational flow of fluid therethrough without a significant reduction in the strength of the components involved.

Still another object of the present invention is to provide an internal-gear machine which can provide for a further reduction in the level of losses due to fluid flowing between intermeshing teeth, without a significant reduction in strength.

Yet a further object of the present invention is to provide an internal-gear pump which provides an enhanced pumping action with reduced fluid losses, compatible with an adequate structural configuration.

In accordance with the present invention, these and other objects are achieved by an internal-gear machine such as a pump comprising an internally toothed annular gear and an externally toothed pinion meshing therewith, with a filling member disposed between the annular gear and the pinion. The annular gear has substantially radial openings therethrough, communicating the external periphery of the annular gear with the inward side thereof in the region of the gaps between the teeth on the inward side of the annular gear. The openings which open into the gaps between the teeth are each set into the respective non-bearing tooth flank which defines one side of the respective gap between a pair of teeth, to such an extent that those openings also provide a communication between the base of the respective tooth and the tip of the tooth.

The construction in accordance with the present invention therefore does not have openings extending to the tips of the respective teeth of the annular gear, separately through the teeth, but the remaining openings which open into the gaps between adjacent teeth are set into the non-bearing flank of the respective tooth in such a way that the openings provide a communication between the root of a tooth and the tip of the tooth. Due to the reduction in the number of openings to half, the openings may be of enlarged cross-section without adversely affecting the overall strength of the annular gear. At the same time the fluid which is to be found between the tips of the teeth of the annular gear and the roots of the teeth of the externally toothed pinion can also pass under a condition of lower flow resistance into the region of the non-bearing tooth flank and from there to the opening through the annular gear. As each opening through the annular gear leads to the outlet of the machine or pump, there is no loss of delivery volume in that construction.

A further advantageous embodiment of the invention provides that, over the height of the edge of each opening, being the edge which is towards the tip of the respective tooth, the tip of the tooth is set back relative to its peripheral surface which defines the crown or addendum circle of the gear. Due to the tip of the tooth being set back in that way, the space available for the fluid to flow to the opening is increased. That is the case in particular when the set-back configuration of the tip of the tooth in the above-specified region extends over the entire width of the tooth because that arrangement also provides a larger flow cross-section for the fluid which is axially remote from the opening, to permit the fluid readily to be delivered to the opening for it to flow therethrough. In addition, the fact that the tip of the tooth is set back in the portion thereof in which the opening intersects the peripheral surface of the teeth, at the side towards the tips thereof, ensures that the resulting edge does not eliminate the film of lubricant on the tips of the teeth in relation to the filling member or even causes the filling member to be subjected to a milling or grinding effect. In both those cases, the internal-gear machine would very quickly suffer from a breakdown, with all the disadvantages that that entails.

In accordance with another advantageous feature of the invention, the tip of the respective tooth may be set back in the above-indicated part of the opening either in the form of a flat chamfer portion or in the form of a concave channel or flute configuration, but advantageously in the form of a combination of both a chamfer portion and a channel or flute. In the last-mentioned case it is desirable for the chamber portion to extend over a part, starting from the peripheral surface of the tooth, of the height of the edge of the opening, which edge is towards the tip of the tooth, while the channel or flute directly adjoins same. That arrangement promotes the formation of a film of lubricant in relation to the filling member in the region of the chamfer portion and in the transition between the chamfer portion and the flat peripheral surface of the tip of the tooth, while the adjoining channel or flute configuration forms the flow cross-section for that amount of fluid which is to be found at the ends of the teeth and which has to be caused to flow to the opening.

Although it is possible to envisage two openings which are disposed in axially side-by-side relationship being provided in relation to each gap between a pair of teeth, a single opening per gap, of suitably large cross-section, is more advantageous. The openings may be in the form of simple bores, that is to say, openings of a circular cross-sectional configuration. It is advantageous however for the openings to be of a cross-sectional configuration in which at least at the side of the opening which penetrates into the flank of the corresponding tooth, the cross-sectional configuration thereof is straight and parallel to the flank line of the corresponding tooth. That configuration means that the line of intersection with the tooth flank in the region of the tip of the tooth is also a straight intersection line extending parallel to the direction of the tooth or the flank line. With that arrangement on the one hand the height of the set-back portion at the tip of the tooth, as referred to above, can be minimised, while on the other hand the flow cross-section of the opening is larger precisely in the region of the flank of the corresponding tooth. That also shortens the flow path between the ends of the teeth and the opening in the tooth.

It will be noted that, when the openings are of the cross-sectional configuration just discussed above, which is defined by a straight line at at least one side, it may be difficult to produce such openings by cutting boring on an annular gear on which the teeth have already been formed. In that connection, in accordance with an advantageous development of the invention, the annular gear may be made up from two separate portions, the plane of separation of which is disposed in the region of the openings. The annular gear is advantageously divided precisely in the plane of symmetry thereof. That arrangement affords the possibility of making the two portions of the hollow gear by sintering or by extrusion pressing, wherein the parts forming the openings may be formed directly on the annular gear portions. It should be noted however that making the annular gear from two separate portions is also advantageous when the recesses produced in the respective portions, which subsequently co-operate to provide the openings, are produced by a cutting machine operation, because the side surfaces of the annular gear are much more readily accessible in that case.

Further objects, features and advantages of the present invention will be aparent from the following description of a preferred embodiment thereof.

DESCRIPTION OF THE PREFERRED EMBODIMENT

Figure 1:
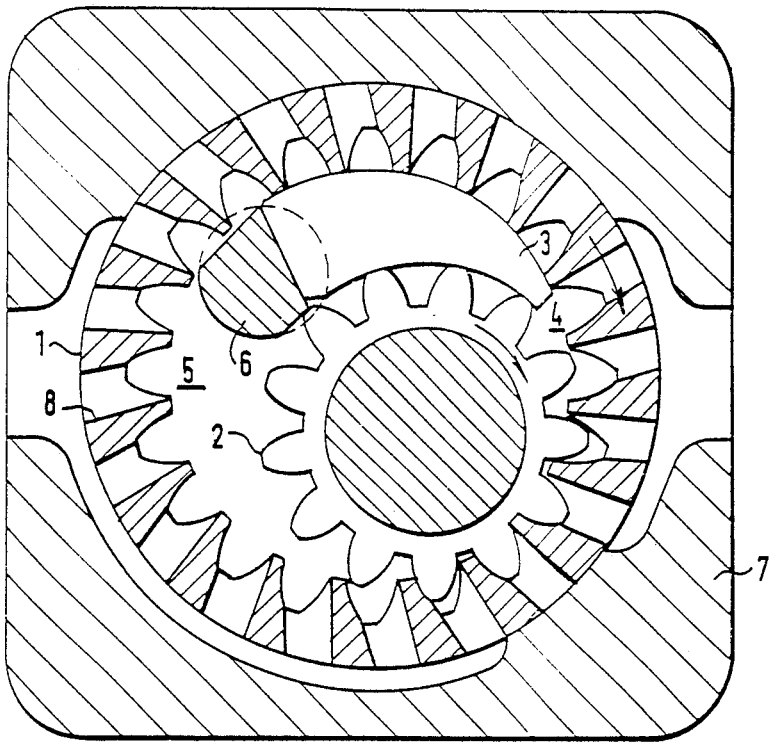
FIG. 1 is a view in cross-section through an internal-gear pump according to the invention, in which casing portions surrounding the annular gear are only schematically indicated.

Referring firstly to FIG. 1, in an internal-gear machine such as an internal-gear pump, an internally toothed annular gear 1 is disposed rotatably in a housing, while an externally toothed pinion 2 is disposed rotatably within the annular gear 1 and in meshing engagement with a portion thereof. A filling member 3 is disposed in the space between the pinion 2 and the remaining portion of the annular gear 1, separating a pressure chamber 4 of the pump from a suction or intake chamber 5. The filling member 3 is supported on a rotatably mounted pin 6. The annular gear 1 is mounted directly in a cup-like casing as indicated at 7 and has at least substantially radial openings 8 which extend therethrough, communicating the external periphery of the annular gear 1 with the inward side thereof, through which the medium or fluid to be conveyed by the pump can flow from the pressure chamber 4 to a pump outlet (not shown).

Figure 3:
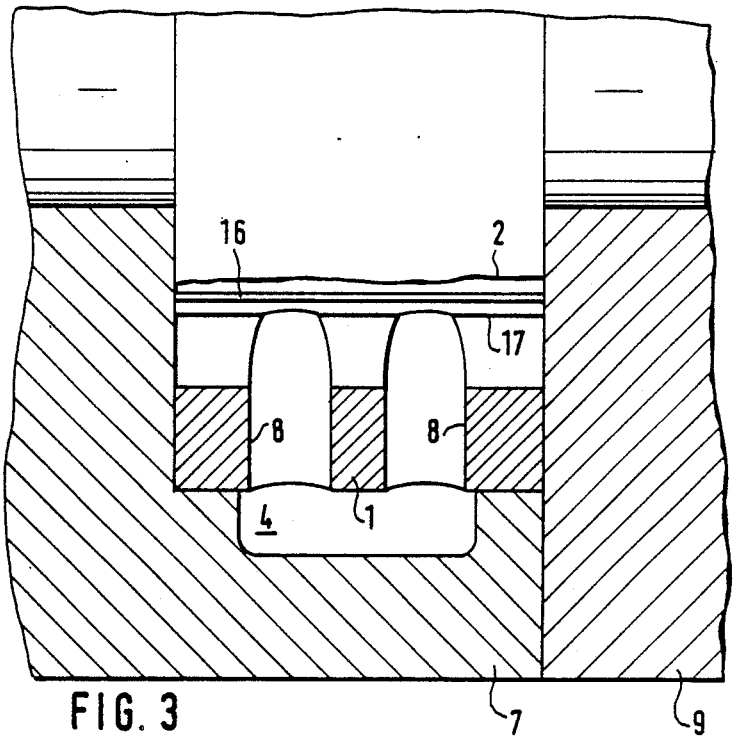
FIG. 3 is a view in section taken along line III—III in FIG. 2.

As shown in FIG. 3, the cup-shaped casing 7 is closed off at its open side by a mounting cover as indicated at 9.

With the exception of the particular shape and arrangement of the openings 8, the structure and mode of operation of the machine shown in FIG. 1 are known and therefore do not need to be described in greater detail herein.

Referring now to FIG. 3, it will be seen therefrom that there are two openings 8 disposed in side-by-side relationship, for each gap between a pair of teeth of the annular gear 1. It will be seen from FIG. 2 that in the region of the pressure chamber 4, the teeth 12 of the pinion 2 progressively penetrate to an increasing degree into gaps 13 between adjacent pairs of teeth as indicated at 11 and in that way displace the fluid in the gaps 13, out of the gaps.

The openings 8 are arranged asymmetrically with respect to the radial central plane of the gaps 13, in such a way that each opening passes through the flank 14 of the respective tooth 11, which is the rearward flank in the direction of rotation of the annular gear 1 and the pinion 2, that flank 14 therefore being the non-bearing flank of the respective tooth.

Figure 2:
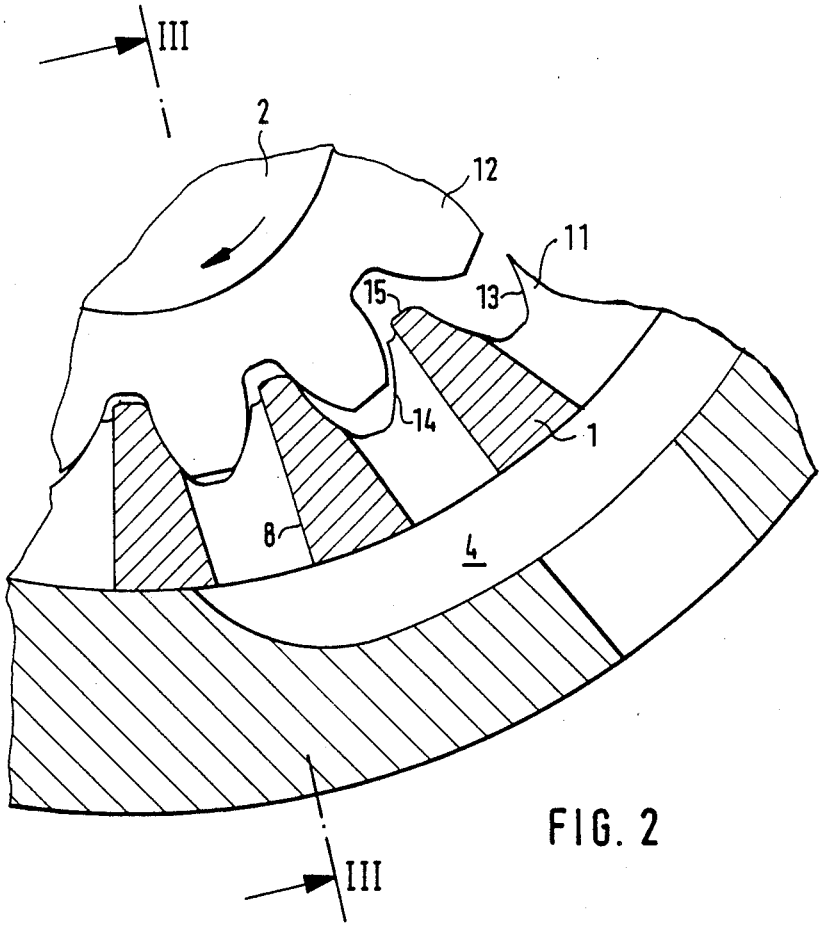
FIG. 2 is a view in cross-section on an enlarged scale of part of the construction shown in FIG. 1, illustrating the meshing engagement between the teeth of the pinion and the annular gear in the pressure chamber of the pump.

In the embodiment illustrated in FIG. 2, each opening is in the form of a bore of a diameter such that the bore involves the root of the respective tooth, both in the bearing and also the non-bearing flanks of the respective tooth 11, as well as the tip of the tooth, in the region of the non-bearing flank 14 thereof. The part of the tip 15 of the tooth through which the edge of the opening 8 passes is set back in a manner which can be seen in FIG. 2 but which is even more clearly illustrated in FIG. 5.

As can be seen therefrom therefore, disposed adjoining each side of the inwardly facing peripheral surface 15 of the tip of each tooth is a respective chamfer portion 16 which extends over the entire width of the tooth. Adjoining the chamfer portion 16, at the side of the tooth at which the non-bearing flank 14 is to be found, is a convex channel or flute as indicated at 17 in FIG. 5. The flute 17 is of greater height than the chamfer portion 16, as can be clearly seen from FIG. 5, and the flute 17 also extends over the entire width of the tooth. As a result of that configuration, as the teeth 12 of the pinion 2 pass into the gaps 13 between the teeth 11 of the annular gear 1, the fluid which is thereby displaced out of the gaps 13 can be urged into the respective openings 8. When that happens, in the last stage of meshing interengagement between the teeth 11 and 12 of the annular gear 1 and the pinion 2 respectively, being the stage in which the space, towards the roots of the teeth, between the teeth 12 of the pinion 2 is substantially closed off by the tips of the respective teeth 11 of the annular gear 1, as can be clearly seen from FIG. 2, the chamfer portion 16 but in particular the flute 17 serve as flow passages for a flow towards the openings 8, for the portion of fluid which are to be found laterally outside of the openings 8.

Figure 4:
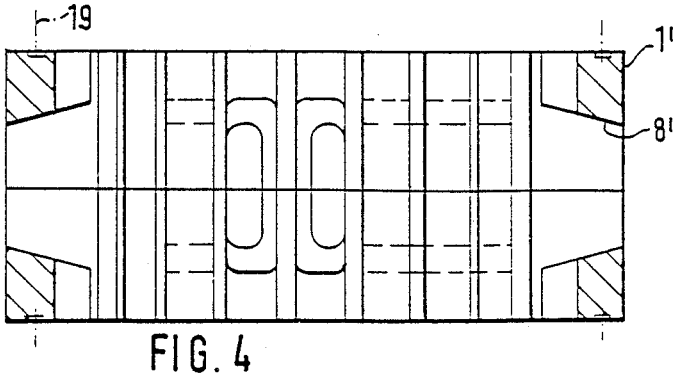
FIG. 4 is a view in axial section through an embodiment of an annular gear which is divided in its central plane.
Figure 5:
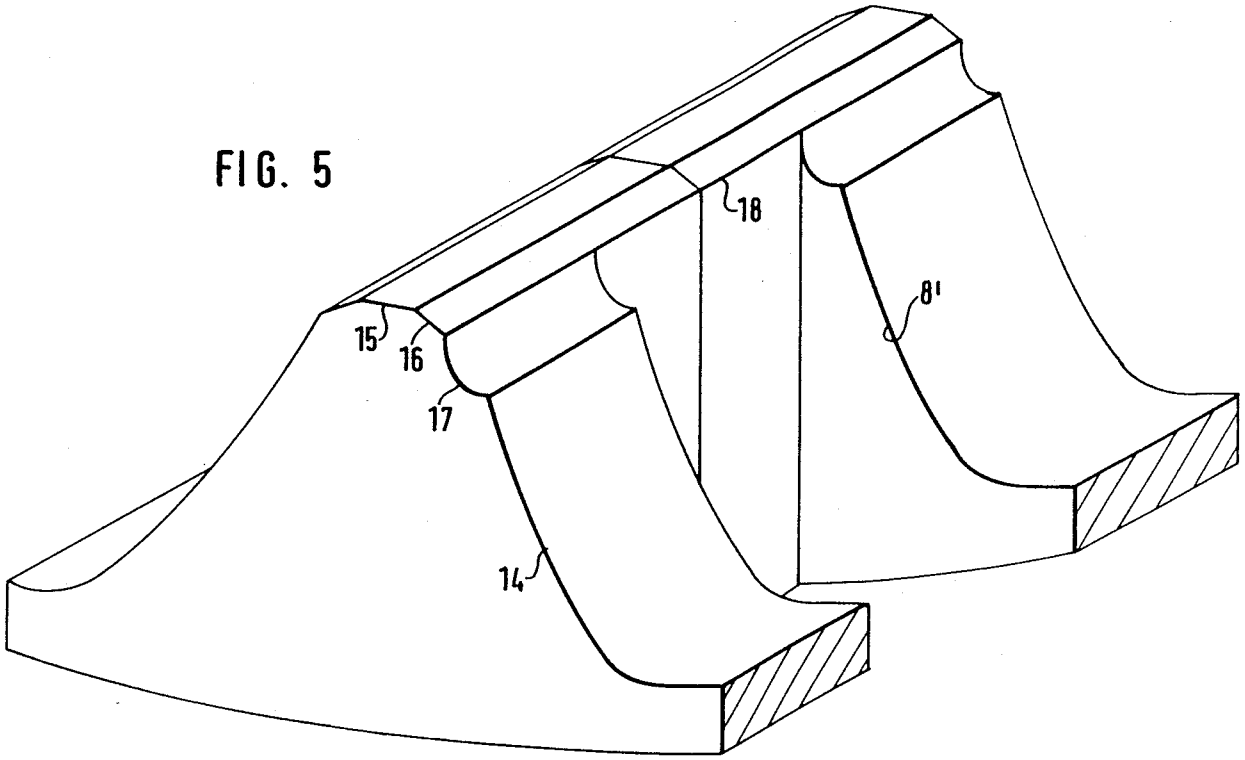
FIG. 5 is a perspective view of a tooth of the annular gear shown in FIG. 4.

While the embodiment shown in FIGS. 2 and 3 provides that the openings 8 are in the form of simple bores of round cross-section, the embodiment shown in FIGS. 4 and 5 differs therefrom by virtue of the openings 8' being of a different cross-sectional shape. As can be seen more specifically from FIG. 4, the openings which are indicated at 8' therein taper in cross-section from their end which is disposed inwardly of the annular gear 1', outwardly thereof, and, in particular in the region of the non-bearing flank 14 of the respective teeth, have a straight-line boundary to their cross-sectional configuration, which extends parallel to the flank line of the respective tooth. That provides a correspondingly straight intersection line as indicated at 18 in FIG. 5 with the tip of the tooth, which line 18 is aligned with the edge formed at the transition between the chamfer portion 16 and the channel or flute 17. In the construction shown in FIGS. 4 and 5, the annular gear 1' is also divided in its central plane which at the same time is the plane of symmetry of the openings 8' so that in that way the illustrated form of the openings 8' can be produced more easily, as referred to above. The two portions or halves of the annular gear 1' are connected together by means which are only schematically indicated at 19 in FIG. 4, for example screw means disposed at a number of peripheral locations on the annular gear 1', which extend through the teeth thereof.

Figure 6:
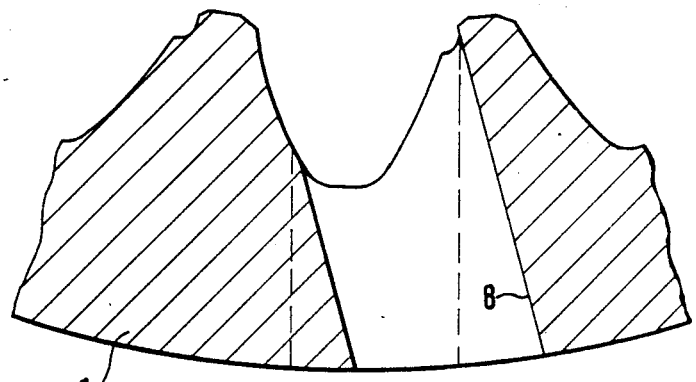
FIG. 6 is a view on an enlarged scale of the gap between two teeth, showing the position and the direction of the opening disposed therebetween.

Reverting now to FIG. 1, it will be seen therefrom that, while the openings 8 extend substantially radially through the annular gear 1, the openings 8 are not precisely aligned with their longitudinal axis disposed radially relative to the centre point of the annular gear 1, but extend inclinedly at an acute angle relative to the corresponding radius. In that arrangement the mouth orifice of each opening 8 on the peripheral surface of the annular gear 1 is displaced relative to the mouth orifice of the same opening 8, at the inward side of the annular gear 1 which carries the teeth 11, in the opposite direction to the direction of rotation of the annular gear 1. The reason for adopting that positioning of the openings 8 lies in the resulting possibility of making the diameter of the openings 8 larger and thus keeping the level of resistance to flow of fluid through the openings at a lower level. FIG. 6 also shows that situation on an enlarged scale and thus more clearly illustrates the diametral relationship between an opening 8 which is arranged in the above-discussed manner, and an opening which is shown in broken lines in FIG. 6 and the longitudinal axis of which extends precisely radially to the centre point of the annular gear 1.

It will be appreciated that the above-described embodiments of the present invention have only been set forth by way of example and illustration thereof and various modifications and alterations may be made therein without thereby departing from the scope of the invention. Thus for example although it is advantageous for the openings to be arranged symmetrically with respect to the central plane of the annular gear 1 or 1', that is not a necessary arrangement. Furthermore, it is not absolutely necessary for the tips of the teeth of the annular gear to be provided with double chamfer portions as indicated at 16 in FIG. 5, at both sides of the respective tooth tip, as, in order to provide for enhanced formation of a film of lubricant on the filling member 3, it is sufficient for only the non-bearing flank 14 of the respective tooth to be provided with such a chamfer portion. It will also be appreciated that the invention is not restricted to the FIG. 1 construction of an internal-gear pump which uses a divided filling member 3 and which involves the annular gear being mounted directly in the casing, but rather the invention can also be applied to constructions which differ therefrom.

What is claimed is:

1. An internal-gear machine comprising: an internally toothed annular gear; an externally toothed pinion meshing with a portion of the annular gear, the teeth of said annular gear and of said pinion making sealing line contact on their bearing tooth flanks when meshing; and a filling member arranged between the annular gear and the pinion, wherein the annular gear has substantially radial openings therethrough communicating the external periphery of the annular gear with the inward side thereof in the region of the gaps between the teeth thereof, the openings which open into said gaps each being set into a non-bearing gear tooth flank which defines one side of the respective gap between a pair of gear teeth, to such an extent that at the same time said openings produce a communication between the root of each respective gear tooth and the tip of the gear tooth.

2. A machine as set forth in claim 1 wherein over the height of the edge of each opening, which edge is towards the tip of one of the respective gear teeth, the tip of the gear tooth is set back relative to its peripheral surface which defines a crown circle of the gear.

3. A machine as set forth in claim 2 wherein the tip of the gear tooth is set back over the entire width of the gear tooth in the form of a chamfer portion.

4. A machine as set forth in claim 2 wherein the tip of the gear tooth is set back over the width of the gear tooth in the form of a flute.

5. A machine as set forth in claim 3 wherein the tip of the gear tooth is set back over the width of the gear tooth in the form of a flute.

6. A machine as set forth in claim 5 wherein said chamfer portion extends over a part, starting from the peripheral surface of the gear tooth, of the height of the edge of the opening, which edge is towards the tip of the gear tooth, and said flute adjoins same.

7. A machine as set forth in claim 1 wherein the cross-section of said opening is delimited by a straight edge at least at its side which penetrates into said flank and said straight edge extends parallel to the line of the flank of the gear tooth.

8. A machine as set forth in claim 7 wherein the tip of the gear tooth is set back over the entire width of the gear tooth in the form of a chamfer portion and wherein said straight edge of the opening, at the side towards the tip of the gear tooth, aligns with the edge of the chamfer portion.

9. A machine as set forth in claim 7 wherein the tip of the gear tooth is set back over the width of the gear tooth in the form of a flute and wherein said straight edge of the opening, at the side towards the tip of the gear tooth, aligns with the edge of the flute.

10. A machine as set forth in claim 1 wherein said annular gear is formed from two separate portions, the plane of separation of which is disposed in the region of said openings.

11. A machine as set forth in claim 1 wherein the axis of the openings extends inclinedly at an acute angle with respect to an associated radius line of the annular gear.

12. An internal-gear machine comprising: a casing; an internally toothed annular gear mounted rotatably within the casing, the annular gear having a plurality of openings extending substantially radially therethrough and providing a fluid flow communication between the inward side of the annular gear and the external periphery thereof in the region of the gaps between at least some of the teeth of the annular gear, each said opening further communicating with a fluid flow channel portion in the non-bearing flank of a tooth defining one side of the respective gap between a pair of gear teeth, thereby further to provide a fluid flow communication between the tip of the respective gear tooth and the root thereof and therewith the respective said opening; an externally toothed pinion rotatably disposed within the annular gear and meshing with a portion thereof, the teeth of said annular gear and of said pinion making sealing line contact on their bearing tooth flanks when meshing; a clearance being provided between said pinion and remaining portion of the annular gear; and a generally arcuate filling member disposed in said clearance and extending substantially in the circumferential direction of said annular gear.

* * * * *